US005379571A

United States Patent [19]

Gottfreid

[11] Patent Number: 5,379,571

[45] Date of Patent: Jan. 10, 1995

[54] METHOD AND APPARATUS FOR PACKAGING A STACK OF PAPER IN A CARDBOARD CARTON

[75] Inventor: Thomas M. Gottfreid, Warsaw, Ind.

[73] Assignee: Moore Business Forms, Inc., Grand Island, N.Y.

[21] Appl. No.: 205,560

[22] Filed: Mar. 4, 1994

Related U.S. Application Data

[62] Division of Ser. No. 117,600, Sep. 8, 1993, Pat. No. 5,348,147.

[51] Int. Cl.[6] ..... B65B 5/06; B65B 7/28; B65B 43/42

[52] U.S. Cl. ..... 53/471; 53/243; 53/284.5; 53/447; 53/462

[58] Field of Search ..... 53/243, 242, 447, 449, 53/462, 485, 475, 471, 282, 284.5, 207, 173, 540, 531, 169

[56] References Cited

U.S. PATENT DOCUMENTS

| | | | |
|---|---|---|---|
| 3,951,049 | 4/1976 | Brackmann et al. | 53/485 X |
| 3,986,319 | 10/1976 | Puskarz et al. | 53/462 X |
| 4,683,705 | 8/1987 | Meives et al. | 53/462 |
| 4,936,816 | 6/1990 | Blumle et al. | 53/243 X |
| 5,255,493 | 10/1993 | Molison et al. | 53/243 X |

FOREIGN PATENT DOCUMENTS

| | | | |
|---|---|---|---|
| 2-127206 | 5/1990 | Japan | 53/243 |

*Primary Examiner*—James F. Coan
*Attorney, Agent, or Firm*—Nixon & Vanderhye

[57] ABSTRACT

A cardboard carton is constructed that is particularly useful for holding a stack of paper so that individual cut sheets from the stack may be readily removed. The carton bottom has an open top and substantially open ends and closed sides, while the carton top has a Z-fold top panel, and one or more tear strips between adhesive connecting the carton top to the carton bottom and the main part of the carton top. The carton bottom, with its open top facing downwardly, is either moved over a stack of paper, or formed over the stack of paper. Then it is rotated 180° about a horizontal axis (as by pivoting a U-shaped continuous conveyor about a horizontal axis), and conveyed to a station where it is moved with respect to a carton top so that the open bottom of the carton top goes over the carton bottom, and then is glued in place. Two opposite flaps on the carton lid may be glued to the bottom surface of the carton bottom panel to provide a lifting space beneath the carton. The side and end flaps of the carton bottom may be connected to the bottom panel by perforations to allow ready detachment.

20 Claims, 7 Drawing Sheets

Fig. 3
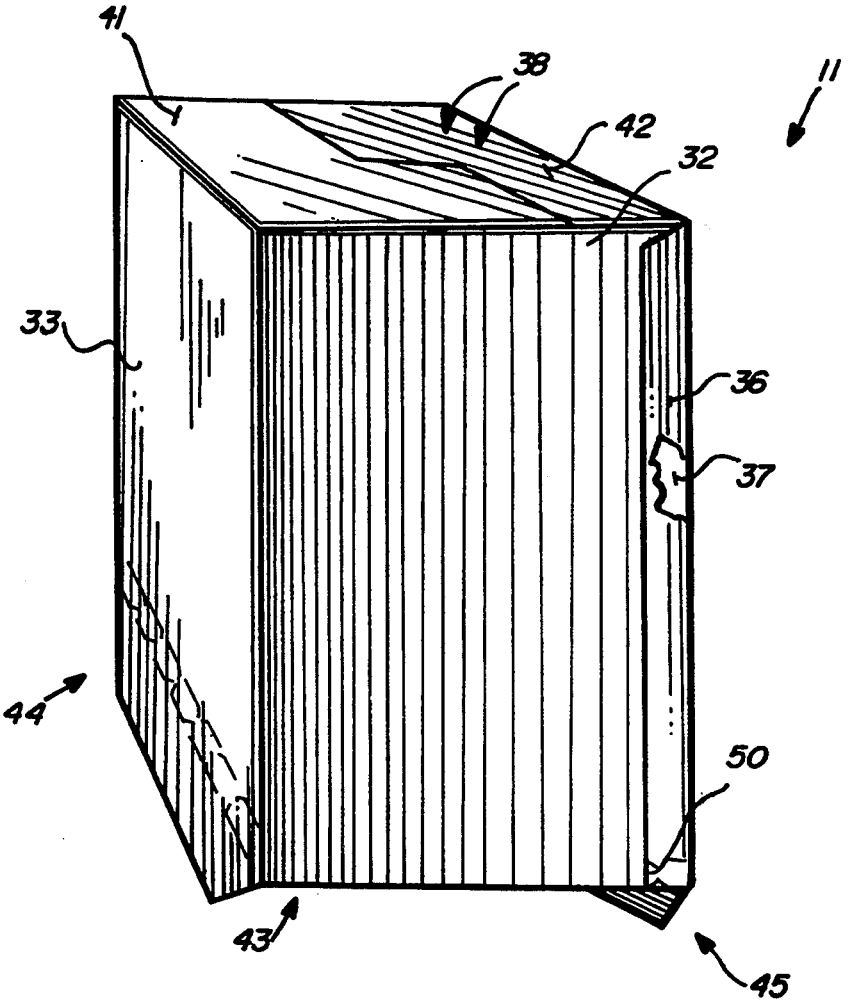
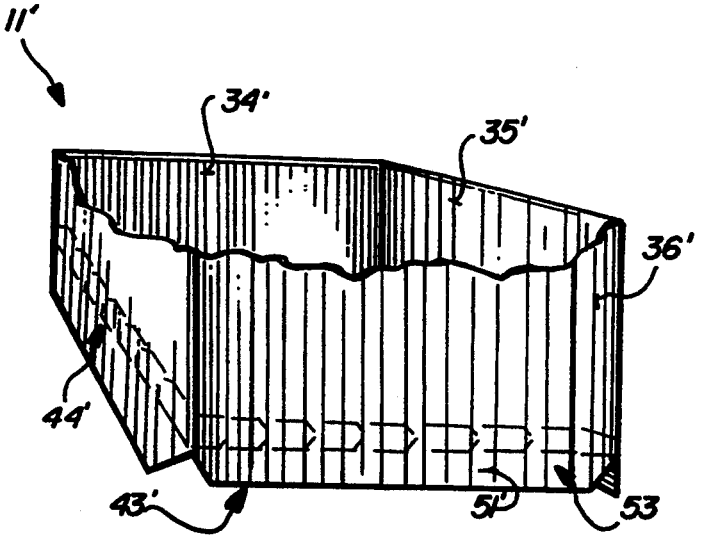
Fig. 5

METHOD AND APPARATUS FOR PACKAGING A STACK OF PAPER IN A CARDBOARD CARTON

This is a divisional of application Ser. No. 08/117,600, filed Sep. 8, 1993, now U.S. Pat. No. 5,348,147.

BACKGROUND AND SUMMARY OF THE INVENTION

Users of high speed page printers, both of laser and conventional type, and users of high speed office copiers, spend a substantial amount of time unwrapping reams of wrapped cut singles before placing them in a printer or photocopier. There are further disadvantages associated with ream wrapping: ream wrapping the paper requires ream wrap machines which have a substantial capital cost; the paper wrap itself has a substantial cost and may not be readily recyclable in offices which merely recycle conventional white paper; and there is a power cost for wrapping the reams.

Users of cut single sheets also wish to be able to quickly lift out a handful of sheets from a carton to place in a printing or photocopying machine, and many users desire a reusable carton made of recyclable material, preferably of only one type (that is not plastic bands or plastic wraps), but at the same time need to protect the cut sheets from edge damage, dust, dirt and moisture penetration.

According to the present invention carton components which fulfill these desired objectives are provided. Also, according to the present invention a method of packaging a stack of paper in a cardboard carton is provided, as well as apparatus for practicing that method.

According to a first aspect of the present invention, a combination of cut paper sheets packaged in a cardboard carton is provided. The combination comprises: At least one thousand cut unwrapped sheets of paper of the same length and width, provided in a stack having a stack height. A cardboard carton packaging the sheets and allowing ready dispensing therefrom, the carton comprising: first and second channel shaped side walls, each formed by a base and a pair of legs substantially perpendicular to the base, the legs of the channels facing each other, and the channels each having a first height greater than the stack height; a bottom panel; first and second end flaps having a second height less than half of the first height; the bases of the channel shaped sides and the end flaps integral with the bottom panel; and fastener means for holding the end flaps to the channel legs to form a carton with an open top and primarily open ends and substantially closed sides.

The fastener means for holding the end flaps to the channel legs preferably comprise adhesive disposed on the inside faces of the side flaps. A user of the cut paper sheets may reach into the primarily open ends of the cardboard carton and remove any desired number of sheets, while the carton protects the edges of the sheets, and is reusable, and is substantially entirely of recyclable material. The bases of the channel shaped sides and end flaps may be connected to the bottom panel by lines of weakness (e.g. perforations).

While the carton as described above may be packaged merely by providing plastic straps around the side walls, or a plastic wrap around the entire carton, preferably it comprises a carton bottom, and a cardboard carton lid is associated with the cardboard carton bottom and cut sheets. An exemplary cardboard carton lid may comprise the following elements: Closed first through fourth sides. A Z-fold closure top. An open bottom. And panel extensions of at least two of the sides, each extension comprising first and second parallel lines of weakness and a removable strip between them, and a bottom fastening section, below the lines of weakness, having sufficient dimension to be securely attached to a carton bottom. A pull tab may be associated with the removable strip, and either two opposite extensions, or four extensions, may be provided.

While the carton lid and carton bottom combination as described above is particularly suited for packaging of cut paper sheets, it may also be utilized to package wrapped reams, or continuous form paper, even though some of the advantages of the invention are thereby compromised.

The invention also relates to a method of packaging a stack of paper in a cardboard carton having a bottom with an open top. The method comprises the steps of automatically: (a) Providing the paper in a stack having a height at least as great as the depth of the carton bottom. (b) Providing the carton bottom over the stack of paper so that the open top of the carton bottom faces downwardly. (c) Rotating the carton bottom with paper stack therein, approximately 180° about a horizontal axis so that the open top of the carton bottom faces upwardly. And (d) securing a covering on the carton bottom so that the paper is held within the carton bottom.

Step (b) may be practiced in one of two ways: by forming the Cardboard carton bottom so that its top faces upwardly, automatically grasping an exterior portion of the carton, rotating the carton bottom 180° about the horizontal axis, and pushing the carton bottom over the paper in the stack; or by placing a cardboard blank for construction of the cardboard carton bottom over the top of the paper in the stack, applying adhesive to selected portions of the blank, and deforming the blank so that it forms the carton bottom over the stack of paper, and is held in place by the adhesive.

Step (a) is preferably practiced by providing at least a thousand unwrapped cut sheets of paper. Step (d) is preferably practiced by placing a cardboard carton lid, having an open bottom, over the open top of the carton bottom, and securing the carton top to the carton bottom with adhesive and is further practiced by utilizing a carton top that has extending portions extending downwardly from the closed sides thereof, supplying glue to the extension portions, and then bending over the extension portions so that they engage and seal with the carton bottom, preferably the lowest surface of the carton bottom bottom panel, so as to provide a lifting space facilitating lifting of the carton.

The invention also comprises particular automatic apparatus for practicing the method as set forth above. The apparatus comprises the following elements: Means for providing a cardboard carton bottom over a stack of paper so that the open top of the carton bottom faces downwardly. Means for rotating the carton bottom with paper stacked therein approximately 180° about a horizontal axis so that the open top of the carton bottom faces upwardly. And means for securing a covering on the carton bottom so that the paper is held within the carton bottom.

The means for rotating preferably comprises a substantially U-shaped continuous belt conveyor mounted for pivotal movement about a horizontal axis so that it can be pivoted from a first position in which a first leg of the U is horizontal and at the bottom, to a position in which the second leg of the U is horizontal and at the bottom. There also is preferably provided means for conveying the carton bottom with a stack of paper therein from the rotating means to the covering and securing means. The covering securing means may comprise means for moving a cardboard carton top having an open bottom with respect to the carton bottom having a stack of paper therein and an open top so that the carton too covers the carton bottom, and means for securing the carton top to the carton bottom. The means for providing a cardboard carton bottom over a stack of paper may comprise a vacuum gripper mounted for pivotal motion about a horizontal axis, and mounted for reciprocatory movement in a vertical dimension. A conveying means may be provided for conveying the carton bottom over a stack of paper from the vacuum gripper means to the rotating means. And, the means for providing the cardboard carton bottom over a stack of paper may comprise means for placing a blank cardboard carton bottom on the top of said stack of papers, and means for deforming the cardboard carton blank over the stack of papers so that the carton bottom is formed over the stack.

It is a primary object of the present invention to provide for the simple yet effective delivery of paper for users of high speed page printers and office copiers, particularly cut sheets. This and other objects of the invention will become clear from an inspection of the detailed description of the invention and from the appended claims.

BRIEF DESCRIPTION OF THE DRAWINGS

FIG. 3 is a top perspective view of an exemplary cardboard carton top according to the present invention;

FIGS. 5 and 6 are detailed views of a second embodiment of carton top, similar to the top of FIGS. 3 and 4 except for the details of the bottom portion thereof;

DETAILED DESCRIPTION OF THE DRAWINGS

Figure 1:
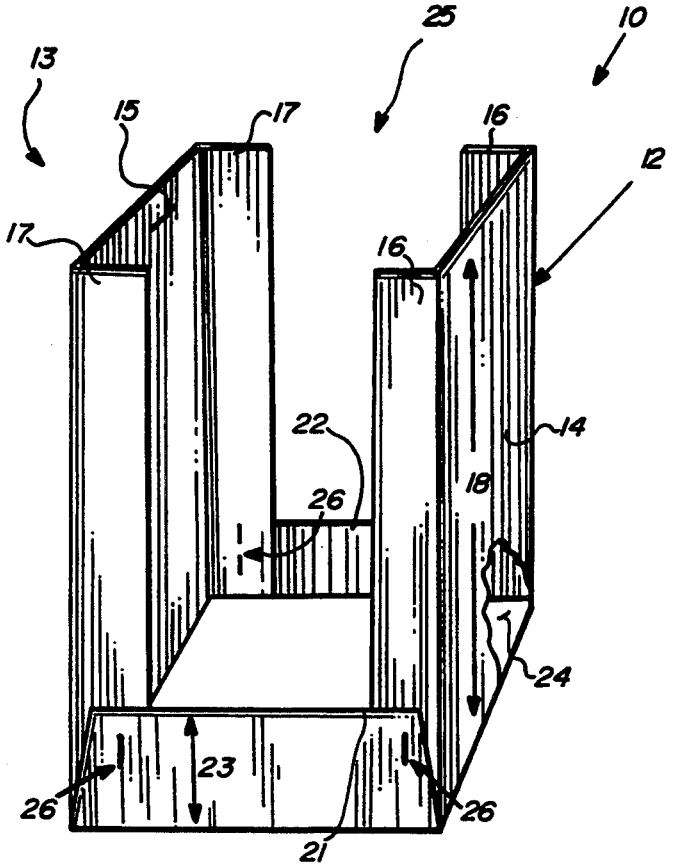
FIG. 1 is a top perspective view of an exemplary cardboard carton bottom according to the present invention.

An exemplary cardboard carton bottom according to the present invention is shown generally by reference numeral 10 in FIG. 1. While the term "cardboard" will be used throughout the specification and claims, it is to be understood that such term is used only generically, and includes corrugated and non-corrugated cardboard and/or paperboard, and all like cellulose materials typically used in cartons. If the carton bottom 10 of FIG. 1 is used with a plastic band or a plastic shrink wrap to hold cut singles therein, about 200–275 pound test paperboard is preferably utilized for the cardboard. However, if bottom 10 is used with a cardboard carton lid, such as the lid 11 in FIG. 3, then bottom 10 is preferably of 200 pound test or lighter B or C fluted corrugated paperboard (e.g. 125 pound test B fluted paperboard).

The carton bottom 10 comprises first and second channel shaped side walls 12, 13, respectively, having bases 14, 15, respectively, with a pair of legs 16, 17, respectively, extending generally perpendicular to the bases 14, 15, and toward each other. The height 18 of the side walls 12, 13 is greater than the height of 1000 cut unwrapped sheets of paper, which are adapted to be received in flat, stacked form within the walls 14, 15 and legs 16, 17, as indicated for the carton bottom 10' in FIG. 7, the stack of cut paper sheets being shown generally by reference numeral 20.

The carton bottom 10 also comprises first and second end flaps 21, 22 having a second height 23 less than half the first height 18. The carton bottom 10 also includes a bottom panel 24 which is integral with the end flaps 21, 22 and the side wall base portions 14, 15, as perhaps seen most clearly in FIG. 2.

Fastener means are provided for holding the end flaps 21, 22 to the channel legs 16, 17 to form a carton bottom 10 with an open top 25 and primarily often ends and substantially closed sides (12, 13). The fastener means may take the form of the staples 26 illustrated in FIG. 1, but preferably take the form of adhesive, such as the adhesive coatings 27 provided on the inside faces of the flaps 21, 22 as seen in FIG. 2.

Figure 2:
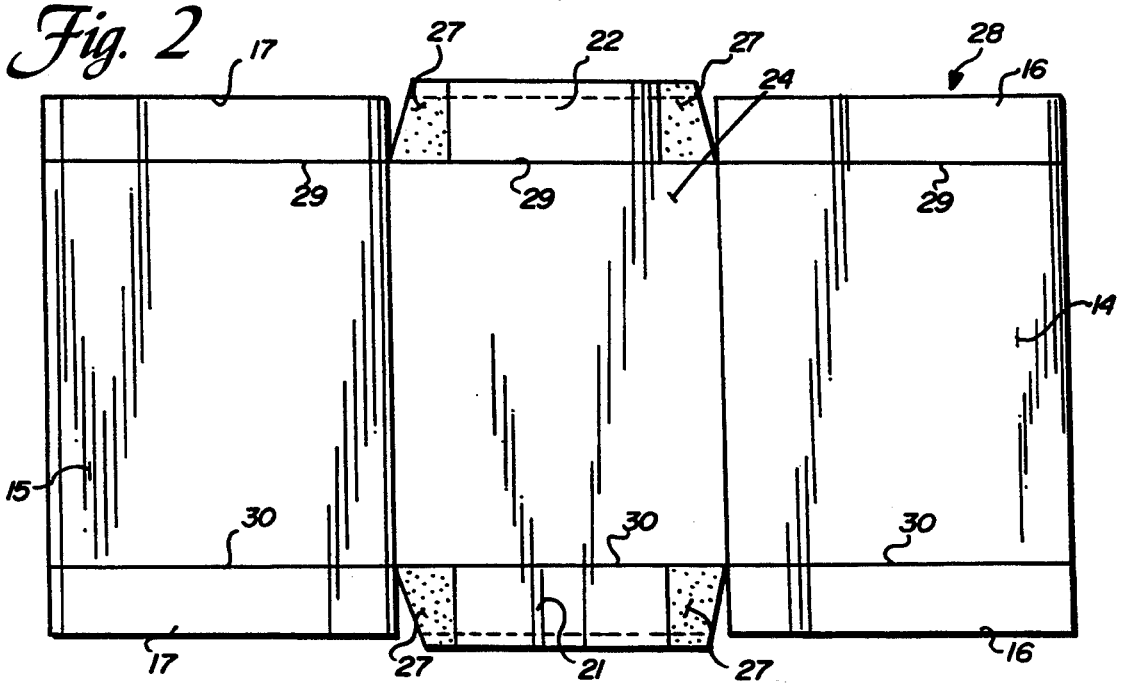
FIG. 2 is a top plan view of a cardboard blank that is subsequently folded to form the carton bottom of FIG. 1.

To form a carton bottom 10 from the carton blank 28 illustrated in FIG. 2, the legs 16, 17 are first folded upwardly (as viewed in FIG. 2) about the fold line 29, 30, and moved to a basically upright position (as illustrated in FIG. 1), and then the panels 21, 22 are also folded about the lines 29, 30 to an upright position and the adhesive 27 thereof pressed into contact with the outer surfaces of the legs 16, 17. The adhesive 27 is preferably a pressure sensitive adhesive which may be manually or automatically pressed into place.

Figure 4:
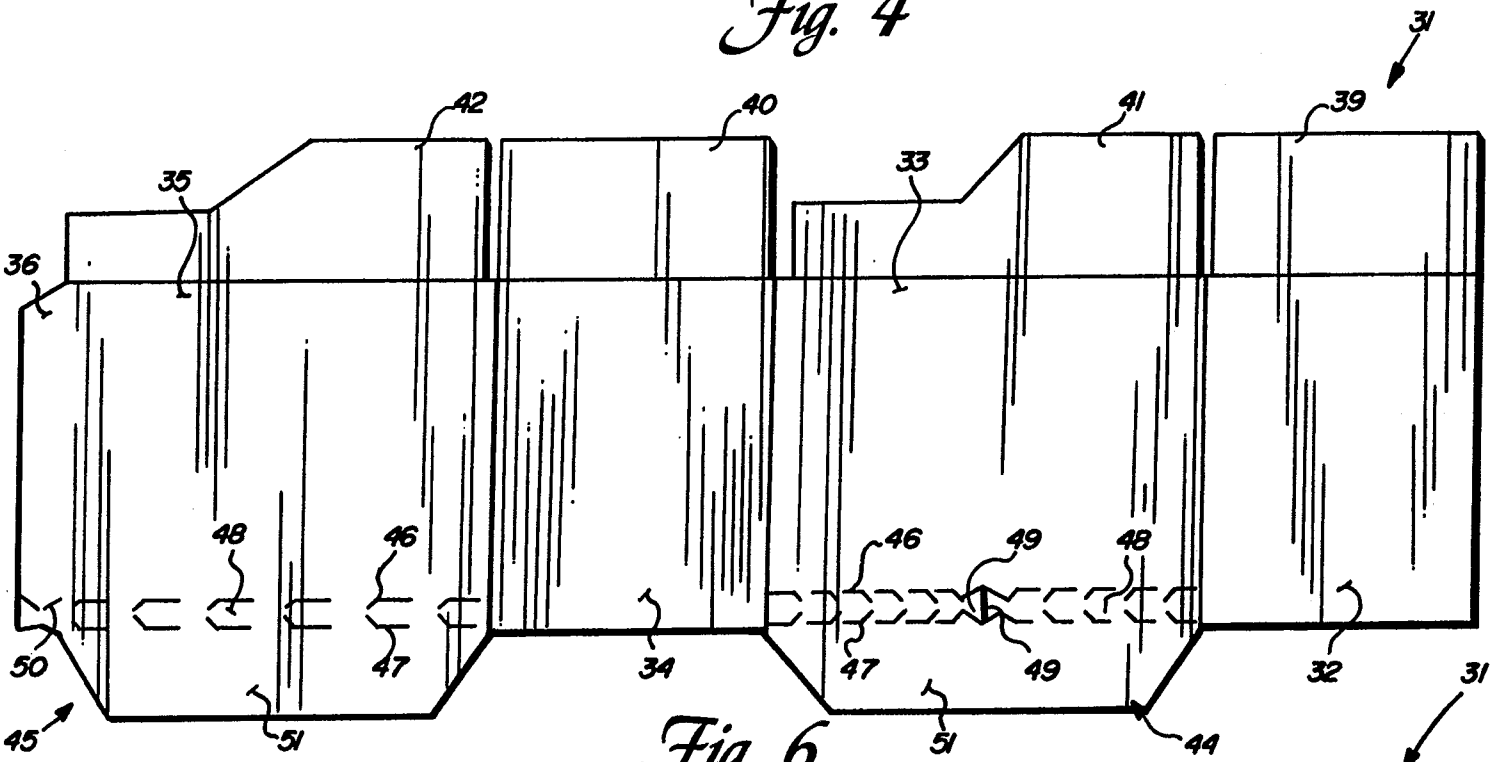
FIG. 4 is a top plan view of one of a blank that may be folded to form the carton top of FIG. 3.

The cardboard carton lid 11 as seen in FIG. 3 is preferably made from the cardboard blank 31 illustrated in FIG. 4. It includes closed first through fourth sides 32–35, with an additional flap 36 extending from the side panel 35 to be wrapped around into engagement with the side panel 32 and held in contact therewith with adhesive 37 (see FIG. 3), staples, or other fasteners.

The carton top 11 is preferably formed with a Z-fold closure top, shown generally by reference numeral 38 in FIG. 3 formed by folding over the panels 39, 40 associated with the panels 32, 34, respectively, and then folding the Z-contoured panels 41, 42 into the Z-closure configuration 38. Preferably glue (not shown) is used to hold the elements 39–42 in place, however, staples or tape may be utilized if desired. Alternatively, the integrity of the folded and interlocked panels 39–42 may be such as to require no glue or other external fasteners.

The carton upper portion 11 also has an open bottom 43, shown schematically in FIG. 3, and a plurality of extensions extending downwardly from the side panels 32 through 35. In the embodiment illustrated in FIGS. 3 and 4, two extensions 44, 45 are provided, associated with the side panels 33, 35, respectively. Each of the extensions 44, 45 has associated therewith first and second parallel lines of weakness 46, 47 (e.g. die cuts, perforations or the like) with a removable strip 48 between them. Associated with the removable strip 48 preferably is a pull tab, such as the two direction pull tabs 49 illustrated for the extension 44 (and like the comparable construction illustrated in U.S. Pat. No. 5,105,950), while the strip 48 associated with the extension 45 has a unidirectional pull tab 50. The extensions 44, 45 each have a bottom fastening section 51 below the lines of weakness 46, 47 having sufficient dimension to be securely attached to a carton bottom, as by adhesive, and again as disclosed for the carton configuration illustrated in U.S. Pat. No. 5,105,950. That is, the bottom fastening sections 51 may be adhesively secured to the end flaps 21 22 of the carton bottom 10.

Figure 6:
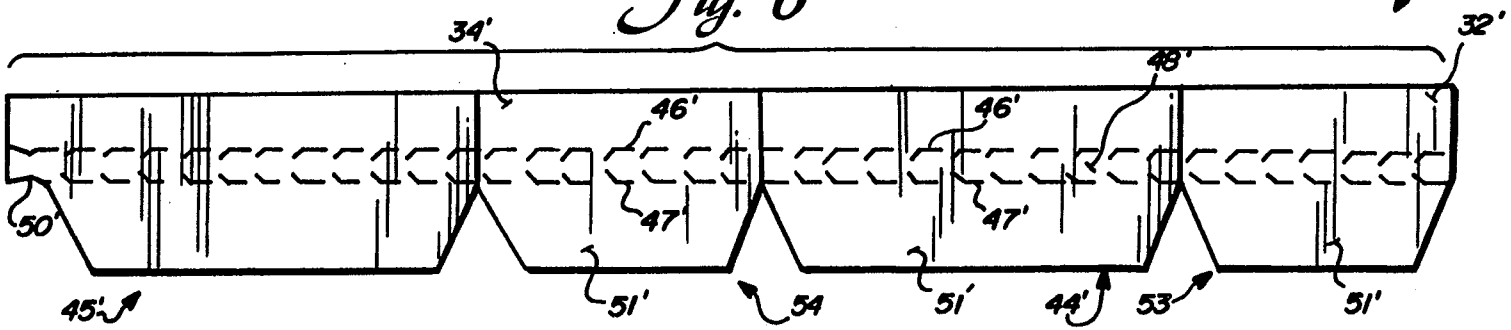
Figure 7:
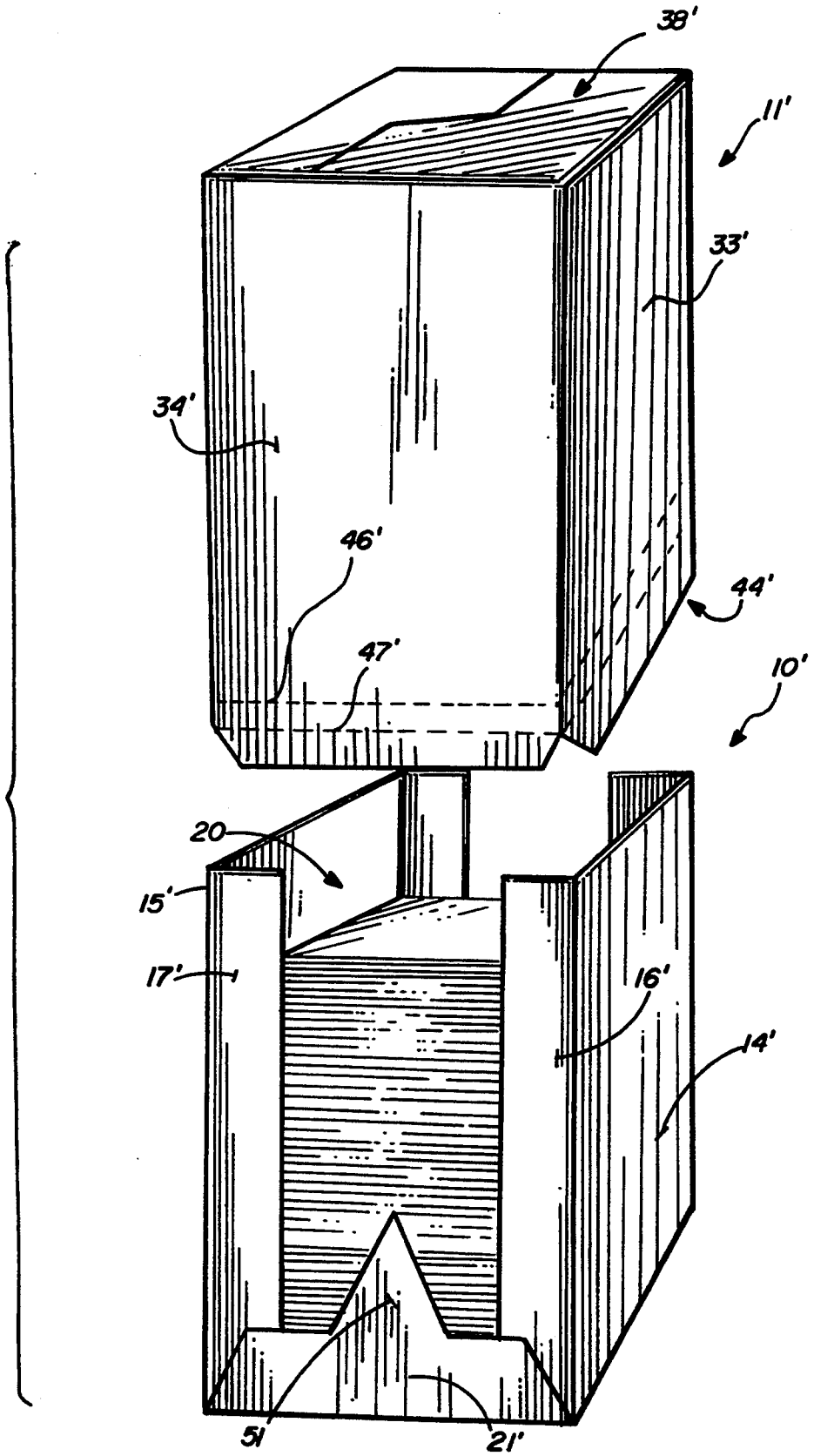
FIG. 7 is a top perspective view of a carton bottom like that of FIG. 1 in combination with a stack of at least a thousand cut sheets of paper, with a carton lid like that of FIG. 5 shown in position to be telescoped thereover.

FIGS. 5 through 7 illustrate a carton upper portion 11' in which components comparable to those in FIGS. 3 and 4 are shown by the same reference numeral only followed by a "'". The major difference between the carton upper portion 11' and the carton upper portion 11 is in the provision of two additional extensions 53, 54 associated with the side panels 32', 34', respectively, so that the lines of weakness 46', 47' extend from one end of the carton blank 31' to the other, and merely a single pull tab 50' is provided. Of course, the bottom sections 51' of the extensions 53, 54 are also adhesively secured to the carton bottom, such as the end flap 21' and the side wall 14' for the carton bottom 10' illustrated in FIG. 7.

FIG. 7 also illustrates a carton bottom 10' which is slightly different than the carton bottom 10 of FIGS. 1 and 2. The only significant difference is that the end flaps (only the end flap 21' being shown) instead of having a straight across top have a design element 57 therein, which does not significantly obstruct removal of the cut sheets 20 from the carton bottom 10', but does provide a slightly different look.

Figure 8:
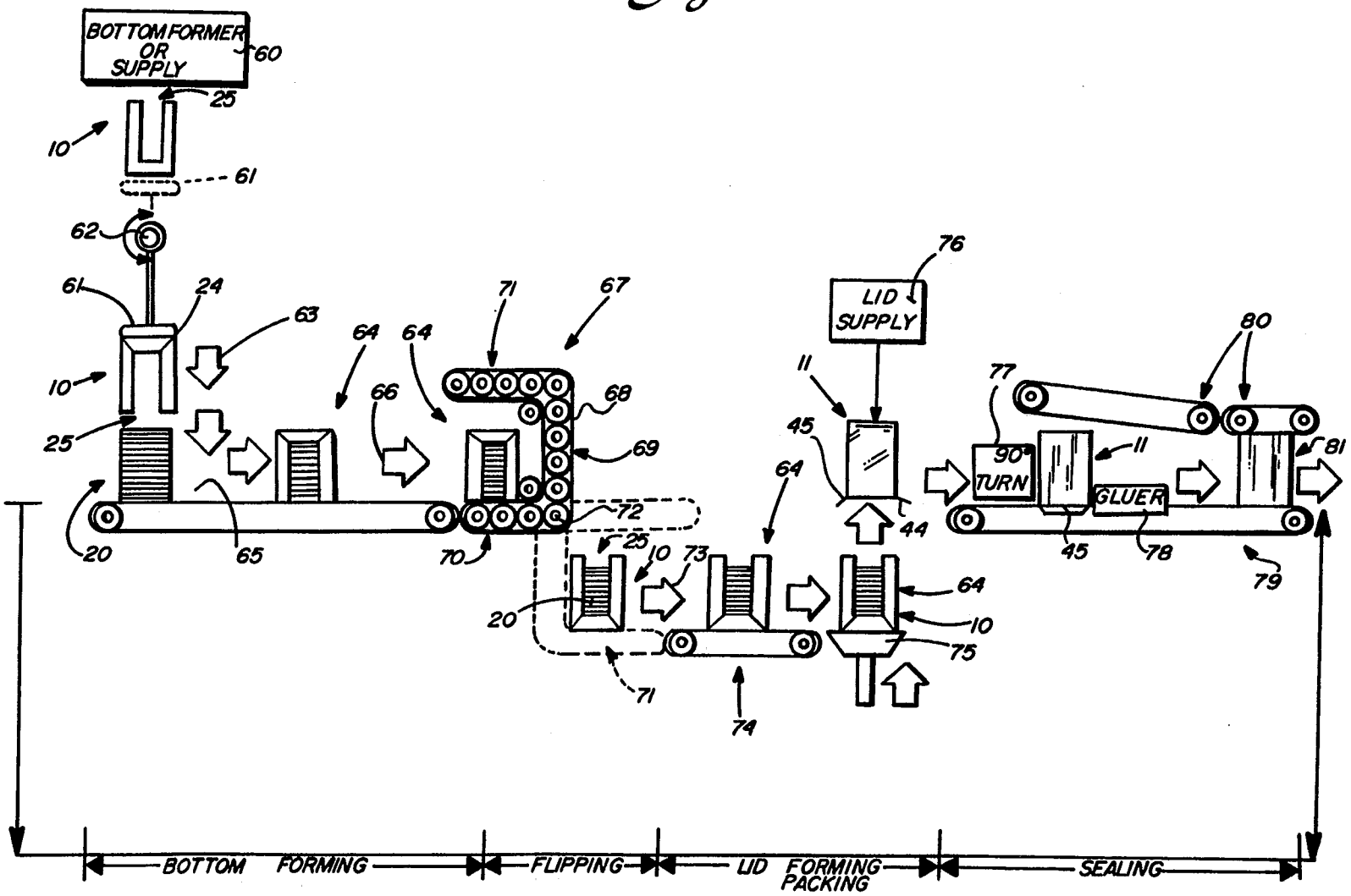
FIG. 8 is a schematic view of exemplary automatic apparatus for forming a final carton with cardboard bottom and top, according to the present invention.

Exemplary apparatus for practicing a method of packaging a stack of paper (such as cut sheets) in a cardboard carton having a bottom 10 with an open top 25 is illustrated schematically in FIG. 8.

The box shown only schematically by reference numeral 60 in FIG. 8 either comprises the supply of carton bottoms 10 or a former for making the bottoms 10 automatically by folding about the various fold lines thereof and securing the adhesive 27, or staples 26, in place. An individual carton bottom 10 is often provided in association with a vacuum gripper 61, which engages the bottom panel 24 of the carton bottom 10. As shown by the dotted line configuration of the vacuum gripper 61, it initially is pivoted about the horizontal axis 62 so that the vacuum gripper 61 engages the bottom 24 of the carton component 10 while the top 25 thereof is at the top, and then the vacuum gripper 61 is pivoted 180° about the pivot point 62 to the solid line position illustrated in FIG. 8 so that it is above a stack of paper (preferably 1000 or more cut sheets) 20. Then a hydraulic ram, or like reciprocating element, moves the vacuum gripper 61 downwardly—as indicated by arrows 63 in FIG. 8—so that the open "top" 25 (which is facing downwardly at this point) moves over the stack of paper 20, and slightly compresses it, so that the stack of paper is contained therewithin, as shown by the component 64 in FIG. 8 (which is one of the carton bottoms 10 placed over and completely containing the stack of paper 20).

The procedures described above preferably take place while the stack of paper 20 is provided on an intermittently movable conveyor belt 65 which conveys the component 64 in the direction 66 to a flipping conveyor assembly 67. The flipping conveyor assembly 67 preferably is U-shaped, comprising a continuous conveyor belt 68 that has a base portion 69, and legs 70, 71 extending perpendicularly from the base portion 69 in the same direction and parallel to each other. The entire conveyor assembly 67 is pivoted about a horizontal axis, for example, about the pivot point 72.

The operation of the flipping conveyor 67 is as follows: The conveyor belt 65 moves an element 64 in direction 66 onto the leg portion 70 thereof, which continues to convey the element 64 until it has the position illustrated in FIG. 8, within the U open space of the flipping conveyor 67. Then the flipping conveyor 67 is pivoted about pivot point 72 to a first position in which the element 64 engages the base 69 and is transported therealong into engagement with the other arm 71, and then moves from other arm 71—the dotted line position thereof illustrated in FIG. 8—in the direction of arrow 73 off the flipping conveyor 67 onto another conveyor 74. The now upright element 64 (that is the open top 25 of the carton bottom 10 now in fact being on top) is then moved to a reciprocating element 75 or the like which moves the element 64 vertically with respect to a carton lid 11, e.g., from a lid supply or former 76. This relative reciprocating vertical movement between the lid 11 and the bottom component 10 causes the lid 11 to completely contain the bottom 10.

For the embodiment illustrated in FIG. 8, the lid 11 is the configuration having only two extensions 44, 45. The element 64, then contained within the lid 11, is preferably rotated 90° at station 77, and then moved to a gluer 78 or the like. The rotating mechanism 77, gluer 78, and associated compression, adhesion, and accumulated conveyors—shown only schematically by reference numerals 79 and 80 in FIG. 8—preferably are the same as comparable components illustrated in FIGS. 6 through 8 of U.S. Pat. No. 5,105,950, the disclosure of which is hereby incorporated by reference herein. The end carton 81 produced has a lid 11 adhesively secured to a bottom 10 and paper stacked therein, preferably a thousand or more unwrapped cut paper sheets 20.

Figure 9:
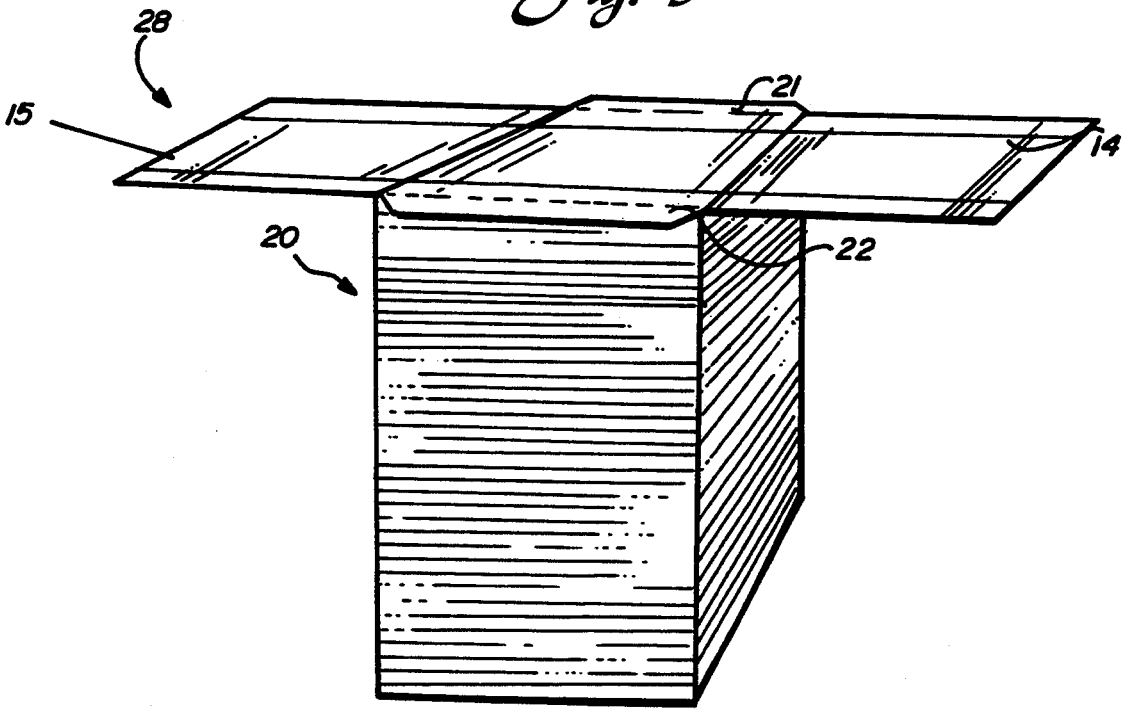
FIGS. 9 and 10 show consecutive perspective stages that are alternatives to the bottom forming apparatus and method of FIG. 8.
Figure 10:
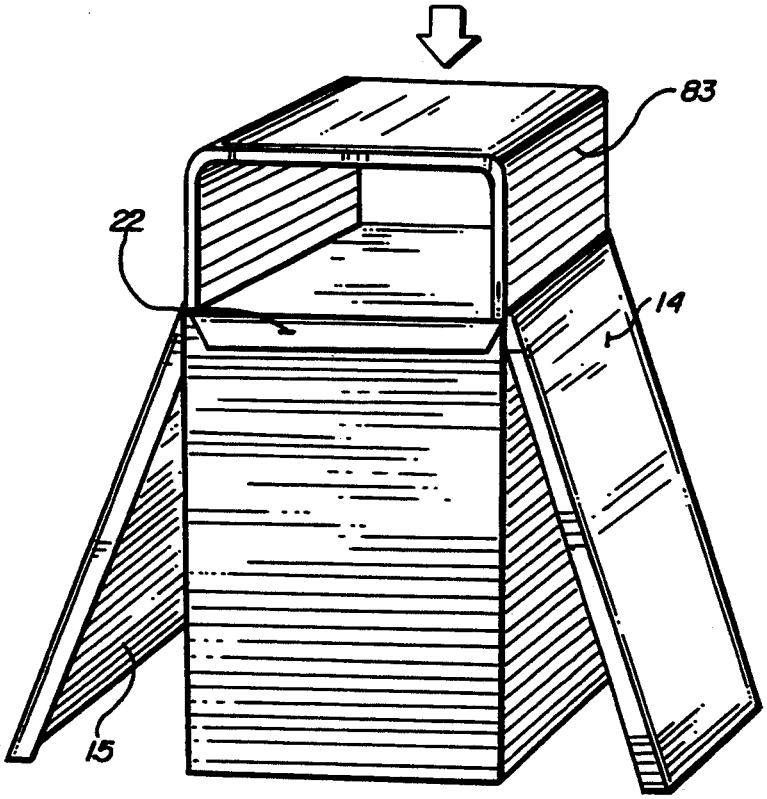

FIGS. 9 and 10 schematically illustrate an alternative to the bottom forming section of the apparatus of FIG. 8. In this particular configuration the blank 28 is placed over the stack of unwrapped cut paper sheets 20 (see FIG. 9), and then one or mere rams 83 are utilized to bend over the side panels 14, 15, and the end flaps 21, 22, after the adhesive 27 (see FIG. 2) has been applied, as illustrated schematically in FIG. 10. The flipping, lid forming/packing, and sealing stations are the same as those illustrated in FIG. 8.

Figure 11:
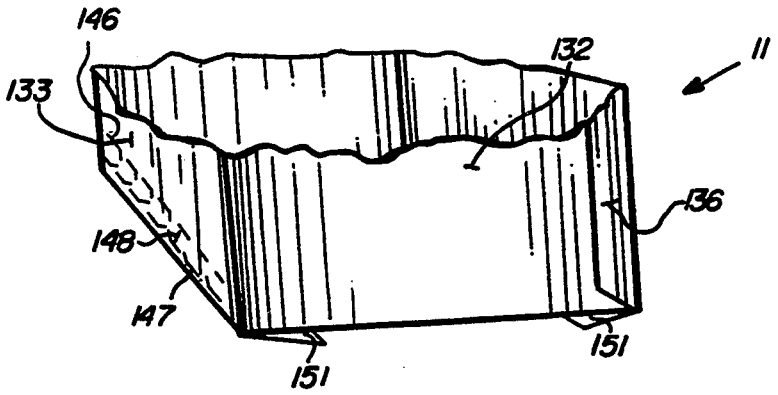
FIG. 11 is a partial perspective view of another embodiment according to the invention where the carton top and bottom are shown connected together.
Figure 12:
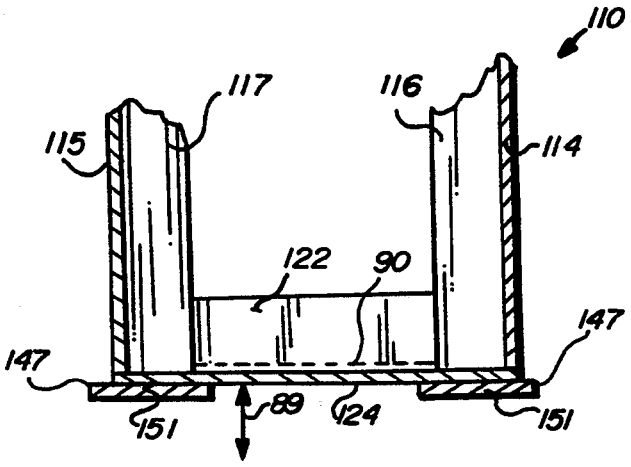
FIG. 12 is a cross-sectional view of a part of the carton bottom of the FIG. 11 embodiment after the carton top has been detached therefrom.
Figure 13:
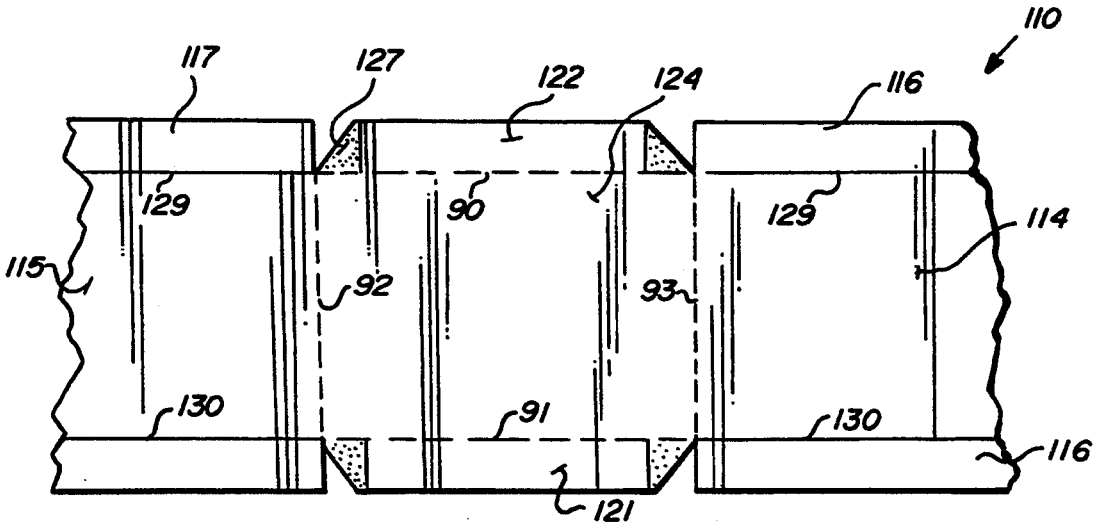
FIG. 13 is a view like that of FIG. 2 only showing the alternative construction of the carton bottom of FIGS. 11 and 12.

Another embodiment according to the invention is illustrated in FIGS. 11–13. In these figures components comparable to those in FIGS. 1–4 are shown by the same reference numeral only preceded by a 1. FIG. 11 shows the carton top 111 fastened to the carton bottom (not seen in FIG. 11 but interior of the top 111). In this particular configuration of the carton top 111, the flaps 151 are designed to be folded over at the bottom and glued to the bottom panel 124 of the carton bottom 110, as seen in FIG. 12, which illustrates the construction of FIG. 11 once the strips 148 have been grasped and pulled so as to detach along the lines of weakness 146, 147. An advantage of this particular embodiment—as seen in FIG. 12 (the paper stacked within the carton bottom 110 has been removed from FIG. 12 for clarity of illustration)—is that a lifting area 89 is provided below the bottom panel 124, formed by the thicknesses of the flaps 151, which allows a user to easily insert his or her fingers, or a lifting device, under the bottom panel 124 between the flaps 151 so as to easily lift the stack of papers within the bottom 110 (along with the bottom 110). This lifting feature is accomplished without the necessity of any additional structure, merely by proper utilization of the otherwise wasted flaps 151.

The carton bottom 110 of FIGS. 12 and 13 also is slightly different than the carton bottom of FIGS. 1 and 2. In the FIGS. 12 and 13 embodiment, instead of score lines 129 and 130 extending all the way through the bottom panel 124 from the side panels 114, 115 (as is provided in the FIGS. 1 and 2 embodiment), perforation lines 90, 91, or other lines of weakness, are provided separating the flaps 121, 122 from the bottom panel 124. Also, perforation lines (or other lines of weakness) 92, 93 are also provided separating the bottom panel 124 from the side panels 114, 115. Thus, after the carton has been opened, if desired the user can remove the flaps 121, 122, and side panels 114, 115 from the bottom panel 124 (or remove selective ones thereof) in a relatively simple manner, thus allowing ready access to the sheets mounted by the carton in different manners and/or allowing the ready recyclability of various portions of the carton at locations where it is easier or more desirable to recycle the carton portions.

It will thus be seen that according to the present invention it is possible to package unwrapped cut paper singles/sheets in such a way that they are readily removed in any quantity desired for loading of a high speed printer or a copier, yet the cut sheets are delivered in a low cost, undamaged condition, and the packaging utilized therefor is essentially all readily recyclable cardboard. This is accomplished in an automated and cost effective manner.

While the invention has been herein shown and described in what is presently conceived to be the most practical and preferred embodiments thereof, it will be apparent to those of ordinary skill in the art that many modifications may be made thereof within the scope of the invention which scope is to be accorded the broadest interpretation of the appended claims so as to encompass all equivalent structures, devices, and processes.

What is claimed is:

1. A method of packaging a stack of paper in a cardboard carton having a bottom with an open top, comprising the steps of automatically:

(a) providing the paper in a stack having a height at least as great as the depth of the carton bottom;

(b) providing the carton bottom over the stack of paper so that the open top of the carton bottom faces downwardly by forming the cardboard carton bottom so that its top faces upwardly, automatically grasping an exterior portion of the carton, rotating the carton bottom 180° about the horizontal axis, and pushing the carton bottom over the paper in the stack;

(c) rotating the carton bottom with paper stack therein, approximately 180° about a horizontal axis so that the open top of the carton bottom faces upwardly; and (d) securing a covering on the carton bottom so that the paper is held within the carton bottom.

2. A method as recited in claim 1 wherein step (b) is practiced by placing a cardboard blank for construction of the cardboard carton bottom over the top of the paper in the stack, applying adhesive to selected portions of the blank, and deforming the blank so that it forms the carton bottom over the stack of paper, and is held in place by the adhesive.

3. A method as recited in claim 1 wherein step (d) is practiced by placing a cardboard carton lid, having an open bottom, over the open top of the carton bottom, and securing the carton top to the carton bottom with adhesive.

4. A method as recited in claim 3 wherein the carton bottom has a bottom panel with a lowest surface and wherein step (d) is further practiced by utilizing a carton top that has two extending portions extending downwardly from two opposite closed sides thereof, applying glue to the extension portions, and then bending over the extension portions so that they engage and seal with the carton bottom panel lowest surface, to provide a lifting space.

5. Apparatus for packaging a stack of paper in a cardboard carton comprising:

means for providing a cardboard carton bottom over a stack of paper so that the open top of the carton bottom faces downwardly;

means for rotating the carton bottom with paper stacked therein approximately 180° about a horizontal axis so that the open top of the carton bottom faces upwardly while simultaneously moving the carton bottom horizontally and downwardly; and means for securing a covering on the carton bottom so that the paper is held within the carton bottom.

6. Apparatus as recited in claim 5 wherein said means for rotating comprises a substantially U-shaped continuous belt conveyor mounted for pivotal movement about a horizontal axis so that it can be pivoted from a first position in which a first leg of the U is horizontal and at the bottom, to a position in which the second leg of the U is horizontal and at the bottom.

7. Apparatus as recited in claim 6 further comprising means for conveying the carton bottom with a stack of paper therein from said rotating means to said covering and securing means.

8. Apparatus as recited in claim 5 wherein said covering and securing means comprising means for moving a cardboard carton top having an open bottom with respect to the carton bottom having a stack of paper therein and an open top so that the carton top covers the carton bottom, and means for securing the carton top to the carton bottom.

9. Apparatus as recited in claim 5 wherein said means for providing a cardboard carton bottom over a stack of paper comprising a vacuum gripper mounted for pivotal motion about a horizontal axis, and mounted for reciprocatory movement in a vertical dimension.

10. Apparatus as recited in claim 9 further comprising conveying means for conveying the carton bottom over a stack of paper from said vacuum gripper means to said rotating means.

11. Apparatus as recited in claim 5 wherein said means for providing the cardboard carton bottom over a stack of paper comprises means for placing a blank for defining a cardboard carton bottom on the top of the stack of paper, and means for deforming the cardboard carton blank over the stack of papers so that the carton bottom is formed over the stack.

12. Apparatus for packaging a stack of paper in a cardboard carton comprising:

means for providing a cardboard carton bottom over a stack of paper so that the open top of the carton bottom faces downwardly, said means comprising a vacuum gripper mounted for pivotal motion about a horizontal axis, and mounted for reciprocatory movement in a vertical dimension;

means for rotating the carton bottom with paper stacked therein approximately 180° about a horizontal axis so that the open top of the carton bottom faces upwardly; and means for securing a covering on the carton bottom so that the paper is held within the carton bottom.

13. Apparatus as recited in claim 12 wherein said means for providing the cardboard carton bottom over a stack of paper comprises means for placing a blank for defining a cardboard carton bottom on the top of the stack of paper, and means for deforming the cardboard carton blank over the stack of papers so that the carton bottom is formed over the stack.

14. Apparatus as recited in claim 12 wherein said covering and securing means comprising means for moving a cardboard carton top having an open bottom with respect to the carton bottom having a stack of paper therein and an open top so that the carton top covers the carton bottom, and means for securing the carton top to the carton bottom.

15. A method of packaging a stack of loose paper sheets in a cardboard carton having a bottom with an open top, comprising the steps of automatically:

(a) providing the loose paper sheets in a stack having a height at least as great as the depth of the carton bottom;

(b) providing the carton bottom over the stack of paper so that the open top of the carton bottom faces downwardly;

(c) rotating the carton bottom with the stack of loose paper sheets therein, approximately 180° about a horizontal axis so that the open top of the carton bottom faces upwardly; and (d) securing a covering on the carton bottom so that the stack of loose paper sheets is held within the carton bottom.

16. A method as recited in claim 15 wherein step (b) is practiced by placing a cardboard blank for construction of the cardboard carton bottom over the top of the paper in the stack, applying adhesive to selected portions of the blank, and deforming the blank so that it forms the carton bottom over the stack of paper, and is held in place by the adhesive.

17. A method as recited in claim 15 wherein step (a) is practiced by providing a stack of at least 1000 cut unwrapped paper sheets.

18. A method as recited in claim 15 wherein step (d) is practiced by placing a cardboard carton lid, having an open bottom, over the open top of the carton bottom, and securing the carton top to the carton bottom with adhesive.

19. A method as recited in claim 18 wherein the carton bottom has a bottom panel with a lowest surface and wherein step (d) is further practiced by utilizing a carton top that has two extending portions extending downwardly from two opposite closed sides thereof, applying glue to the extension portions, and then bending over the extension portions so that they engage and seal with the carton bottom panel lowest surface, to provide a lifting space.

20. A method as recited in claim 15 wherein step (b) is practiced by forming the cardboard carton bottom so that its top faces upwardly, automatically grasping an exterior portion of the carton, rotating the carton bottom 180° about the horizontal axis, and pushing the carton bottom over the paper in the stack.

* * * * *